US007300574B1

(12) United States Patent
Lewis

(10) Patent No.: US 7,300,574 B1
(45) Date of Patent: Nov. 27, 2007

(54) SYSTEM FOR FILTERING STORMWATER-CARRIED DEBRIS FLOWING THROUGH A GUTTER INLET INTO A CATCH BASIN

(75) Inventor: Randy Lewis, Charlotte, NC (US)

(73) Assignee: Erosion Control Products, Inc., Monroe, NC (US)

( * ) Notice: Subject to any disclaimer, the term of this patent is extended or adjusted under 35 U.S.C. 154(b) by 121 days.

(21) Appl. No.: 11/264,940

(22) Filed: Nov. 2, 2005

(51) Int. Cl.
*E03F 5/14* (2006.01)

(52) U.S. Cl. ..... 210/163; 210/473; 404/4

(58) Field of Classification Search ..... 210/163, 210/164, 473, 474; 404/4, 5
See application file for complete search history.

(56) References Cited

U.S. PATENT DOCUMENTS 6,214,216 B1 * 4/2001 Isaacson ..... 210/164
6,274,036 B1 * 8/2001 Ellis ..... 210/164
7,179,371 B1 * 2/2007 Bistline ..... 210/163
2004/0016692 A1 * 1/2004 Sasaki et al. ..... 210/473
2007/0090033 A1 * 4/2007 Kelley et al. ..... 210/163

* cited by examiner

*Primary Examiner*—Christopher Upton
(74) *Attorney, Agent, or Firm*—Kennedy Covington Lobdell & Hickman, LLP

(57) ABSTRACT

A system for filtering debris carried by stormwater flowing through a gutter inlet into a catch basin utilizes a filter device configured to conform to and to substantially fully cover the gutter inlet and a retainer device for maintaining the filter device in place covering the gutter inlet. The retainer device is attached to the filter device and configured to extend through the gutter inlet to hang gravitationally downwardly into the catch basin. The retainer device is weighted to gravitationally pull and hold the filter device securely against the gutter inlet against dislodgement under the forces of flowing stormwater.

22 Claims, 2 Drawing Sheets

SYSTEM FOR FILTERING STORMWATER-CARRIED DEBRIS FLOWING THROUGH A GUTTER INLET INTO A CATCH BASIN

BACKGROUND OF THE INVENTION

The present invention relates generally to stormwater drainage systems and, more particularly, to a novel system for filtering sediment and debris from stormwater flowing through a gutter inlet and gravitationally therefrom into a catch basin therebelow.

Stormwater drainage systems are commonplace and, indeed, are mandated for virtually all new building construction subject to the regulations of municipal and county building codes throughout the United States. Essentially, a stormwater drainage system comprises a series of catch basins strategically located according to the topography of a given region under development, with the catch basins emptying into drainage pipes leading to existing streams, creeks, lakes or rivers. In the construction of streets in new building developments, catch basins are required to be constructed below grade alongside the streets to receive stormwater runoff via basin inlets formed in roadside storm gutters.

The growing awareness of environmental conservation issues over recent decades has raised awareness of the significant erosion of bare land which can occur during the course of building construction as a result of stormwater drainage over the bare land. Eroded soil in the form of silt and sediment along with other debris can be carried in significant quantities by stormwater runoff along street gutters and into stormwater drainage systems, sometimes to such a significant extent to clog stormwater catch basins and drainage pipes, and in any event taxing the capacities of and polluting existing streams, creeks, lakes and rivers. As a result, most building codes regulated by municipalities and county building offices have implemented regulations requiring various steps to be taken to prevent or at least mitigate stormwater erosion of soil during building construction, including steps such as the erection of silt fences.

Despite these measures, stormwater runoff still carries a not insignificant amount of silt, sediment and other debris into storm drainage systems. As a result, some form of filtering device is now generally required to be installed in gutter inlets into stormwater catch basins during the course of construction projects to attempt to prevent such debris from entering stormwater drainage systems. Various such filtration devices have been proposed, including for example devices described in U.S. Pat. Nos. 5,403,474; 5,632,888; 5,954,952; 6,709,579; and 6,824,677 and published U.S. Patent Application No. 2004/0112811. While many of these devices may be generally effective for their intended purpose and function, the devices which have achieved commercial use tend to be disadvantageously heavy, bulky and unwieldy. Furthermore, in order to prevent the force generated by stormwater runoff, which can be significant during periods of heavy rain, the filtering medium commonly used in these devices tends to be heavy to assist in holding the devices in place. In turn, the filtration medium also tends to impede the free flow of the stormwater runoff which can result in flooding of the adjacent gutters and streets as water is restricted from entering the catch basins.

SUMMARY OF THE INVENTION

It is accordingly an object of the present invention to provide a system for filtering debris carried by stormwater flowing through a gutter inlet into an associated catch basin which addresses the disadvantages of the known prior art. A more particular object of the present invention is to provide a stormwater debris-filtering system which enables the use of low density, lightweight filtration media. Another object of the present invention is to provide a stormwater debris-filtering system which is relatively easy to install at a gutter inlet and will resist the forces of water flowing through the filtering media so as to remain securely in place.

Briefly summarized, the stormwater debris-filtering system of the present invention utilizes a filter device configured in conformity to the gutter inlet to substantially fully cover the gutter inlet exteriorly of the catch basin without passing through the gutter inlet into the catch basin. The filter device is comprised of filtration media selected to prevent passage through the filter device of soil, silt, leaves, sticks and other stormwater-carried debris, while permitting substantially free passage through the filter device of stormwater. A retainer device is provided for maintaining the filter device in covering relation to the gutter inlet. More specifically, the retainer device is attached to the filter device and configured to extend through the gutter inlet and to depend gravitationally downwardly therefrom within the catch basin. The retainer device is weighted sufficiently to gravitationally pull the filter device securely against the gutter inlet to resist dislodgement under the forces of stormwater flowing there through.

It is contemplated that any of various types of filtration media may be utilized in the present invention, and selected according to the particular filtration needs of a given application or environment. It is contemplated that, in various embodiments, it will be desirable for the filtration media to be of a lightweight material having a lesser density than water, such as a filtration media made of a polymeric material, e.g., an expanded polymeric bead material such as expanded polystyrene.

Preferably, the filter device comprises a flexible tubular fabric sock, e.g., of an elongate cylindrical shape, for containing the filtration media. The tubular fabric sock together with the filtration media is preferably deformable into conformity to the gutter inlet. In this manner, the filter device is enabled to conform to the gutter inlet so as to prevent debris-laden stormwater from entering the gutter inlet without flowing through the filter device.

The retainer device may be of various shapes and forms. In one contemplated embodiment, the retainer device comprises a sleeve portion configured to receive the filter device extended longitudinally therethrough and a sack portion for containing a weighting material, such as sand, gravel or soil.

Other various embodiments of the stormwater debris-filtering system of the present invention will be recognizable and understood to persons knowledgeable and skilled in the relevant industry and are intended to be within the scope of the present invention. Without limiting the scope and substance of the invention, further details, features and advantages of the invention will be described and understood from a description of a preferred embodiment as presently contemplated, set forth in the following specification with reference to the accompanying drawings.

DETAILED DESCRIPTION OF THE PREFERRED EMBODIMENT

Figure 1:
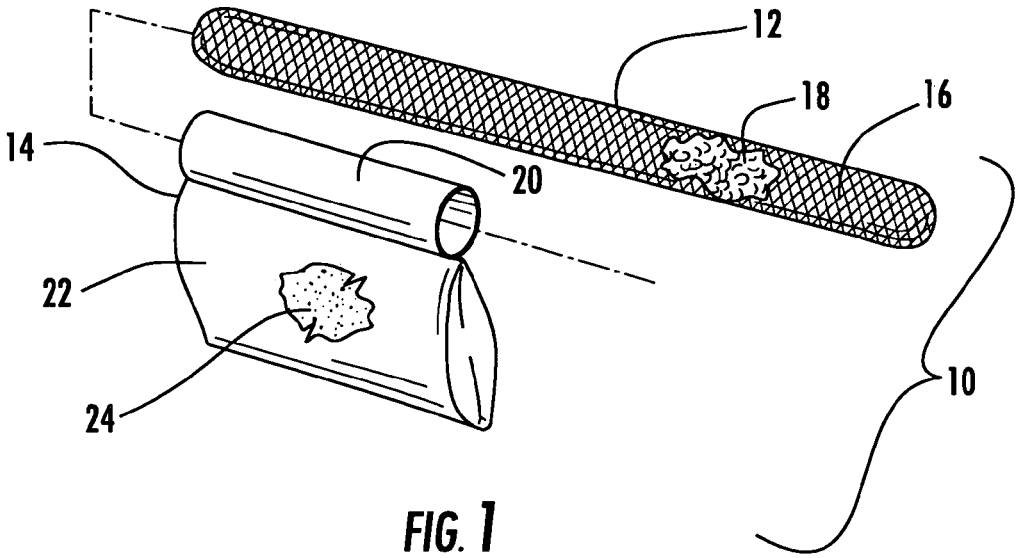
FIG. 1 is a perspective view of the stormwater debris-filtering system of the present invention, with the filter device exploded from the retainer device.

Referring now to the accompanying drawings and initially to FIG. 1, the system of the present invention for filtering stormwater-carried debris is indicated overall in FIG. 1 by reference numeral 10 and basically comprises a conformable filter device 12 attachable to a weighted retainer device 14.

The filter device 12 may be of any of various constructions and configurations so as to be conformable to the shape and size of a gutter inlet of a conventional form of stormwater catch basin. In a presently contemplated embodiment, the filter device 12 may be of an elongate cylindrical shape and sufficiently flexible and deformable to generally mold into conformity to the gutter inlet opening. In the embodiment as illustrated in FIG. 1, the filter device 12 comprises an elongate flexible tubular fabric sock 16 of an open mesh geotextile fabric structure so as to readily permit stormwater to flow therethrough. A quantity of filter media 18 is contained within and fully occupies the filter sock 16. The filter media 18 may be of any of various types, selected to permit substantially free flow of stormwater through the filter media while separating from the stormwater any debris, such as soil, silt, leaves, sticks, and the like carried by the stormwater. While various filter media will provide satisfactory results, one type of filter media which is believed to be quite advantageous is an expanded polymeric bead material, such as expanded polystyrene beads, which offer the advantage of being light weight, while performing efficient filtration of all types of debris with minimal inhibition of water flow through the media.

The retainer device 14 may be of any suitable construction adapted to attach to the filter device and to have sufficient weight to hang gravitationally downwardly from the filter device through a gutter inlet into a catch basin, as described more fully hereinafter. In the embodiment illustrated, the retainer device 14 includes an attachment portion 20 in the form of an open-ended tubular mesh fabric sleeve sized to allow the filter device 12 to be snugly inserted longitudinally through the attachment portion 20. The illustrated embodiment of the retainer device 14 further includes a weighted portion 22 fixed to the attachment portion 20 and configured to pass through a gutter inlet and to depend gravitationally downwardly from the gutter inlet into an associated catch basin. The weighted portion 22 in the illustrated embodiment is preferably in the form of a sack fabricated of a high strength flexible fabric material, such as a tightly woven geotextile material, which can contain a quantity of a weighting material such as sand, gravel or a similar material representatively indicated at 24.

Figure 2:
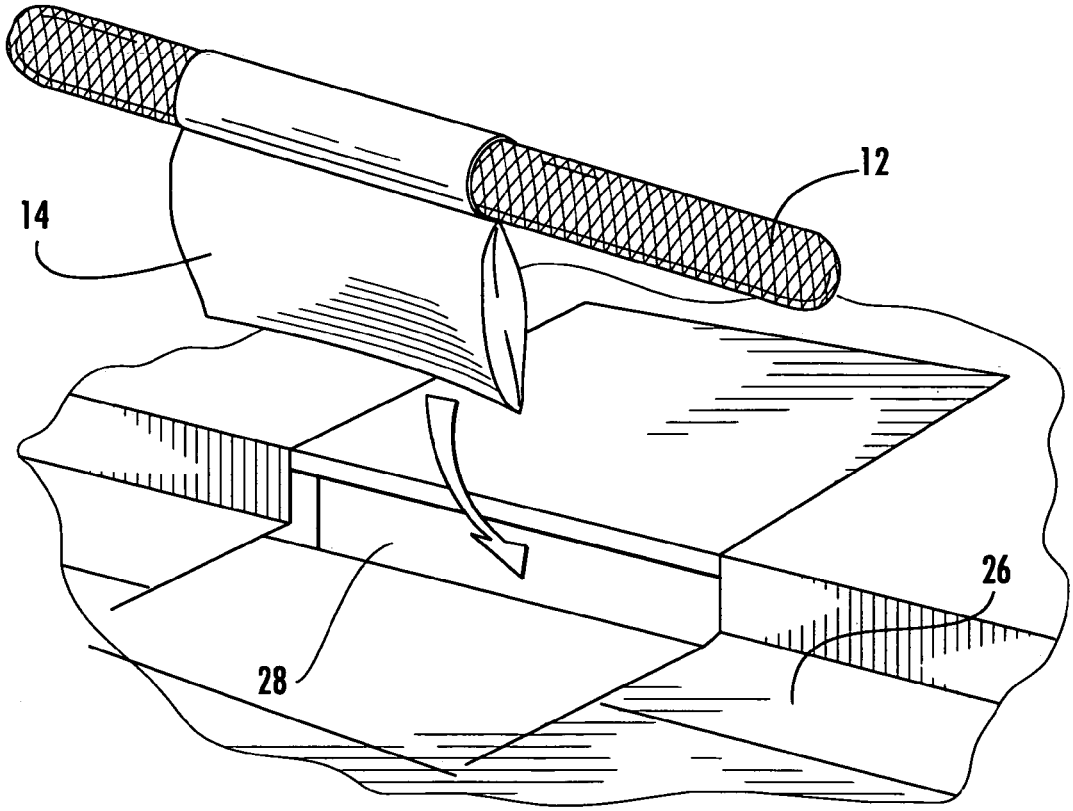
FIG. 2 is a perspective view depicting the stormwater debris-filtering system of FIG. 1 in assembled condition and in the process of being installed into operational disposition in a representative gutter inlet and associated catch basin.
Figure 3:
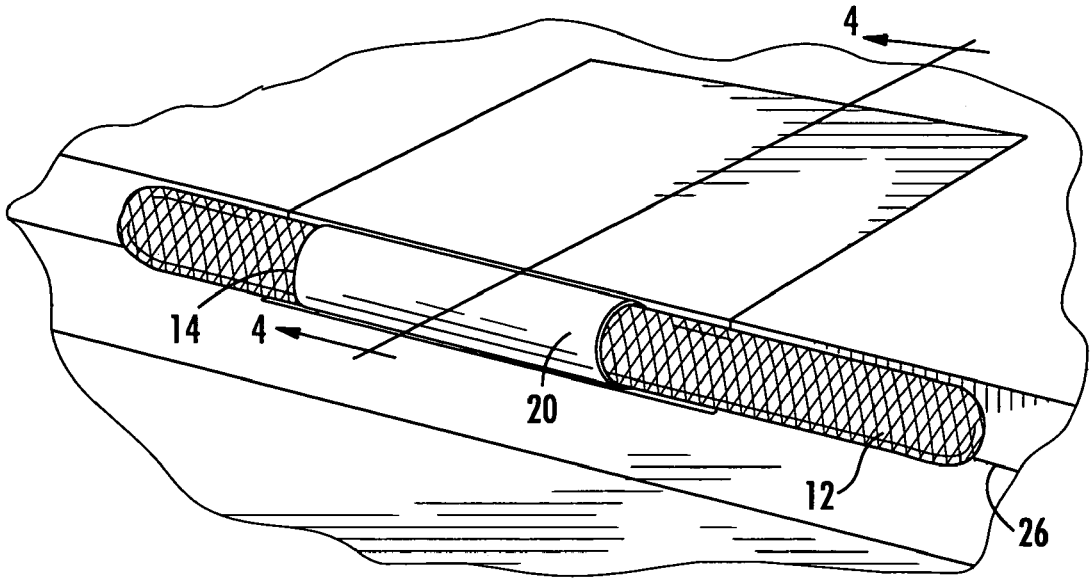
FIG. 3 is a perspective view similar to FIG. 2, depicting the stormwater debris-filtering system of the present invention as fully installed in the gutter inlet and associated catch basin.
Figure 4:
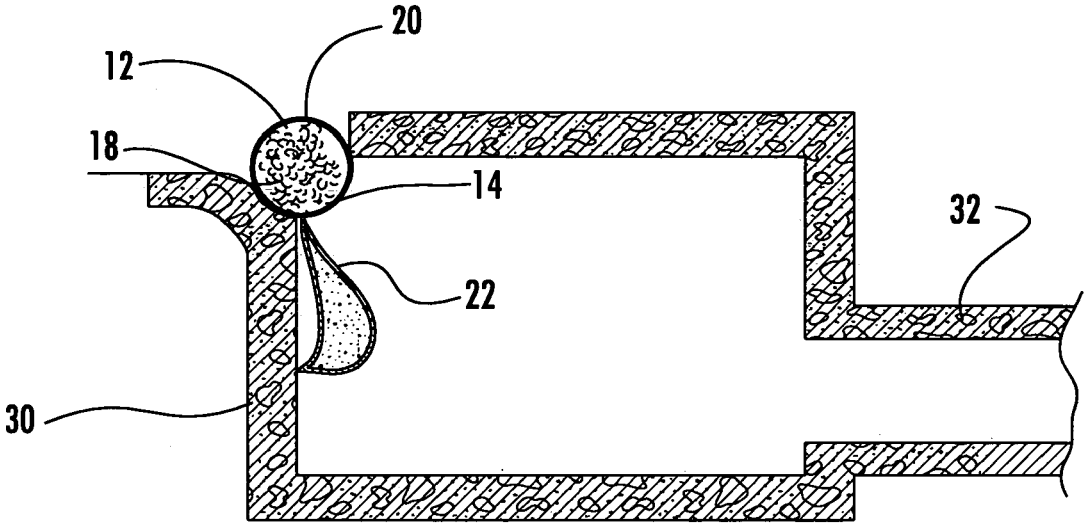
FIG. 4 is a vertical cross-sectional view of the installed stormwater debris-filtering system of FIG. 3, taken along line 4-4 thereof vertically through the gutter inlet, the filtering system, and the catch basin.

The installation and use of the stormwater debris-filtering system 10 of the present invention may best be understood with reference to FIGS. 2-4 of the drawings. In each drawing, a representative form of a convention stormwater drainage system is schematically depicted wherein a roadside stormwater drainage gutter 26 is formed with a gutter inlet opening 28 to drain stormwater runoff gravitationally into a catch basin 30 situated immediately beneath the inlet opening 28 and communicating with a stormwater drainage pipe 32 to transport the runoff stormwater into a natural water collection area, such as a nearby creek, stream, pond, river, etc. The filtering system 10 is assembled with at least one retainer device 14 attached to the filter device 12 and with a sufficient quantity of the weighting material 24 contained within the weighted portion 22 of the retainer device 14. Multiple retainer devices 14 may be utilized in the case of a gutter inlet of significant length requiring a correspondingly long filter device 12. The weighted sack portion 22 of the retainer device 14 is then inserted through the gutter inlet 26 so as to hang therefrom gravitationally downwardly into the catch basin 30. Before releasing the retainer device 14, the elongate filter device 12 is positioned to extend fully along the entire length of the gutter inlet 26. The retainer device 14 is then released, whereby its weight pulls the filter device 12 gravitationally against the gutter inlet. The flexibility of the outer fabric sock 16 together with the deformability of the filter media 18 within the filter sock 16 enables the filter device 12 to mold conformingly to the shape and configuration of the opening of the gutter inlet 28, thereby essentially closing the inlet 28 against entry of stormwater runoff except by flow through the filter sock 16 and filter media 18.

Advantageously, the filtering system of the present invention enables substantially greater flexibility in the selection of varying types of filtering media without concern for the media having sufficient mass and weight to withstand undesired movement under the force of flowing stormwater runoff and, in turn, the filter media may be selected according to the criteria of optimizing the balance between the promotion of substantially free water flow through the device and filtration efficiency in removing silt and other debris. Thus, the present invention enables the use of lightweight, low density polymeric filter material which has not been possible with known filtration devices. In turn, the filtering system of the present invention is easier to handle and to install than known devices while still providing improved results.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A system for filtering debris carried by stormwater flowing through a gutter inlet and gravitationally therefrom into a catch basin therebelow, the filtering system comprising:

a filter device configured in conformity to the gutter inlet to substantially fully cover the gutter inlet exteriorly of the catch basin without passing through the gutter inlet into the catch basin, the filter device being comprised of filtration media selected to prevent passage through the filter device of soil, silt, leaves, sticks, and other stormwater-carried debris, while permitting substantially free passage through the filter device of stormwater, and a separate retainer device for maintaining the filter device in covering relation to the gutter inlet, the retainer device being attached to the filter device and configured to extend through the gutter inlet and to depend gravitationally downwardly therefrom within the catch basin, the retainer device being weighted sufficiently to gravitationally pull the filter device securely against the gutter inlet to resist dislodgement under the forces of stormwater flowing there through.

2. A system for filtering stormwater-carried debris according to claim 1, wherein the filtration media is of a lesser density than the water.

3. A system for filtering stormwater-carried debris according to claim 2, wherein the filtration media is a polymeric material.

4. A system for filtering stormwater-carried debris according to claim 3, wherein the filtration media comprises expanded polymeric beads.

5. A system for filtering stormwater-carried debris according to claim 1, wherein the filter device comprises a flexible tubular fabric sock containing the filtration media, the filter device being deformable into conformity to the gutter inlet.

6. A system for filtering stormwater-carried debris according to claim 1, wherein the retainer device comprises a sleeve portion configured to receive the filter device extended longitudinally therethrough and a sack portion for containing a weighting material.

7. A system for filtering stormwater-carried debris according to claim 6, wherein the weighting material is sand.

8. A system for filtering stormwater-carried debris according to claim 6, wherein the weighting material is gravel.

9. A system for filtering debris carried by stormwater flowing through a gutter inlet and gravitationally therefrom into a catch basin therebelow, the filtering system comprising:

a filter device configured in conformity to the gutter inlet to substantially fully cover the gutter inlet exteriorly of the catch basin without passing through the gutter inlet into the catch basin, the filter device being comprised of filtration media selected to prevent passage through the filter device of soil, silt, leaves, sticks, and other stormwater-carried debris, while permitting substantially free passage through the filter device of stormwater, the filter device being further comprised of a flexible tubular fabric sock containing the filtration media, the filter device being deformable into conformity to the gutter inlet, and a separate retainer device for maintaining the filter device in covering relation to the gutter inlet, the retainer device being attached to the filter device and configured to extend through the gutter inlet and to depend gravitationally downwardly therefrom within the catch basin, the retainer device being weighted sufficiently to gravitationally pull the filter device securely against the gutter inlet to resist dislodgement under the forces of stormwater flowing there through.

10. A system for filtering stormwater-carried debris according to claim 9, wherein the filtration media is of a lesser density than the water.

11. A system for filtering stormwater-carried debris according to claim 10, wherein the filtration media is a polymeric material.

12. A system for filtering stormwater-carried debris according to claim 11, wherein the filtration media comprises expanded polymeric beads.

13. A system for filtering stormwater-carried debris according to claim 9, wherein the retainer device comprises a sleeve portion configured to receive the filter device extended longitudinally therethrough and a sack portion for containing a weighting material.

14. A system for filtering stormwater-carried debris according to claim 13, wherein the weighting material is sand.

15. A system for filtering stormwater-carried debris according to claim 13, wherein the weighting material is gravel.

16. A system for filtering debris carried by stormwater flowing through a gutter inlet and gravitationally therefrom into a catch basin therebelow, the filtering system comprising:

a filter device configured in conformity to the gutter inlet to substantially fully cover the gutter inlet exteriorly of the catch basin without passing through the gutter inlet into the catch basin, the filter device being comprised of filtration media selected to prevent passage through the filter device of soil, silt, leaves, sticks, and other stormwater-carried debris, while permitting substantially free passage through the filter device of stormwater, and a retainer device for maintaining the filter device in covering relation to the gutter inlet, the retainer device comprising a sleeve portion configured to receive the filter device extended longitudinally therethrough and a substantially enclosed sack portion for containing a weighting material, the retainer device being attached to the filter device such that the sack portion is configured to extend through the gutter inlet and to depend gravitationally downwardly from the filter device within the catch basin, the sack portion of the retainer device enclosing and containing a sufficient quantity of the weighting material to gravitationally pull the filter device securely against the gutter inlet to resist dislodgement under the forces of stormwater flowing there through.

17. A system for filtering stormwater-carried debris according to claim 16, wherein the filtration media is of a lesser density than the water.

18. A system for filtering stormwater-carried debris according to claim 17, wherein the filtration media is a polymeric material.

19. A system for filtering stormwater-carried debris according to claim 18, wherein the filtration media comprises expanded polymeric beads.

20. A system for filtering stormwater-carried debris according to claim 16, wherein the filter device comprises a flexible tubular fabric sock containing the filtration media, the filter device being deformable into conformity to the gutter inlet.

21. A system for filtering stormwater-carried debris according to claim 16, wherein the weighting material is sand.

22. A system for filtering stormwater-carried debris according to claim 16, wherein the weighting material is gravel.

* * * * *